US009821479B2

(12) United States Patent
Zuidervaart et al.

(10) Patent No.: US 9,821,479 B2
(45) Date of Patent: Nov. 21, 2017

(54) SHAVER HAVING ADAPTIVE SURFACE

(71) Applicant: KONINKLIJKE PHILIPS N.V., Eindhoven (NL)

(72) Inventors: Jasper Zuidervaart, Eindhoven (NL); Robert Godlieb, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 82 days.

(21) Appl. No.: 14/383,592

(22) PCT Filed: Mar. 13, 2013

(86) PCT No.: PCT/IB2013/051988

§ 371 (c)(1),
(2) Date: Sep. 8, 2014

(87) PCT Pub. No.: WO2013/140309

PCT Pub. Date: Sep. 26, 2013

(65) Prior Publication Data

US 2015/0128776 A1 May 14, 2015

Related U.S. Application Data

(60) Provisional application No. 61/614,147, filed on Mar. 22, 2012.

(51) Int. Cl.
*B26B 19/38* (2006.01)
*B26B 19/42* (2006.01)
(Continued)

(52) U.S. Cl.
CPC ..... *B26B 19/38* (2013.01); *B26B 19/388* (2013.01); *B26B 19/42* (2013.01); *B26B 19/48* (2013.01);
(Continued)

(58) Field of Classification Search
CPC ... B26B 19/3873; B26B 19/388; B26B 19/42; B26B 19/38
(Continued)

(56) References Cited

U.S. PATENT DOCUMENTS 3,316,633 A * 5/1967 Tapper ..... B26B 19/42 30/34.2
3,373,747 A * 3/1968 Tapper ..... A61N 1/36014 30/34.2
(Continued)

FOREIGN PATENT DOCUMENTS

DE 605623 C 3/1935
DE 20115818 * 5/2002 ..... B26B 19/42
(Continued)

OTHER PUBLICATIONS

Robert M. Strong, Donald E. Troxed, member IEEE, "An Electotactile Display" IEEE on Man-Machine Systems, vol. M MS-11, No. 1, Mar. 1970. pp. 72-79.
(Continued)

*Primary Examiner* — Laura M Lee

(57) ABSTRACT

A shaver comprises a skin engaging portion and a cutting element, wherein the skin engaging portion comprises a force-generating member that can be selectively activated during use to increase or decrease a force of attraction to the skin of a user. The force-generating members may be electro-adhesive elements. A controller may be provided to selectively activate these elements.

18 Claims, 4 Drawing Sheets

(51) Int. Cl.
*B26B 19/48* (2006.01)
*B26B 21/40* (2006.01)

(52) U.S. Cl.
CPC ..... *B26B 21/4056* (2013.01); *Y10T 83/0424* (2015.04)

(58) Field of Classification Search
USPC ..... 607/48; 606/20; 30/34.2
See application file for complete search history.

(56) References Cited

U.S. PATENT DOCUMENTS

| | | | | |
|---|---|---|---|---|
| 3,760,497 | A | 9/1973 | Kuhl | |
| 4,089,110 | A | 5/1978 | Rasco | |
| 4,417,397 | A | 11/1983 | Kitamura | |
| 6,070,327 | A * | 6/2000 | Taso | B26B 21/4081 30/34.2 |
| 6,125,542 | A | 10/2000 | Somma | |
| 7,773,363 | B2 | 8/2010 | Pelrine | |
| 9,084,587 | B2 * | 7/2015 | Eckhouse | A45D 26/00 |
| 2005/0216035 | A1 * | 9/2005 | Kraus | B26B 19/388 606/133 |
| 2008/0215039 | A1 | 9/2008 | Slatkine | |
| 2010/0198134 | A1 * | 8/2010 | Eckhouse | B26B 19/46 604/20 |
| 2011/0197726 | A1 | 8/2011 | Kraus | |
| 2012/0191085 | A1 * | 7/2012 | Eckhouse | A45D 26/0028 606/33 |
| 2013/0199348 | A1 * | 8/2013 | Aberizk | B26B 19/42 83/14 |
| 2014/0345142 | A1 * | 11/2014 | Damkat | B26B 21/405 30/34.2 |

FOREIGN PATENT DOCUMENTS

| | | | |
|---|---|---|---|
| WO | 02051598 | A1 | 7/2002 |
| WO | 2010035234 | A1 | 4/2010 |
| WO | 2010066966 | A1 | 6/2010 |
| WO | 2011010246 | A1 | 1/2011 |
| WO | 2011042842 | A1 | 4/2011 |

OTHER PUBLICATIONS

Mallinckrodt et al. "Perception by the skin of electrically induced vibrations", Science 118(3062: 277-278, 1953). Sep. 4, 1953.

Kate Greene, "A Touch Screen With Texture", Technology Review, Oct. 13, 2010.

Philip von Guggenberg, "Electgroadhesion for Industrial, Biomedical, Military, and Consumer Appilcations", SRI International, Jul. 2010.

* cited by examiner

SHAVER HAVING ADAPTIVE SURFACE

This application is the U.S. National Phase application under 35 U.S.C. §371 of International Application No. PCT/IB2013/051988, filed on Mar. 13, 2013, which claims the benefit of U.S. Provisional Application No. 61/614,147 filed on Mar. 22, 2012. These applications are hereby incorporated by reference herein.

BACKGROUND OF THE INVENTION

Field of the Invention

The present invention relates to shavers and more specifically to shavers capable of adapting in use to improve the shaving effect. The invention applies to shavers having both stationary and moveable cutting elements and further relates to methods of operation of such devices.

Description of the Related Art

In shaving it is of interest to control the engagement of a cutting element with the skin to achieve the best and most consistent shaving experience whilst maintaining safety and comfort. The degree to which the skin bulges ahead of a blade or cutting element is termed doming. Increasing the shaving pressure may improve the shaving closeness but can also increase doming. As doming increases, the likelihood that the cutting element will damage the skin also increases. The doming of the skin in a shaving system is therefore of fundamental importance to a shaving experience.

Skin doming for a particular shaving system depends on the system geometry and materials used. It additionally varies due to changes in shaving pressure, speed, direction, area of the body and individual variation of a person's skin properties. There is thus considerable variation in terms of the risk of cutting and the shaving closeness that can be achieved without damaging skin or causing discomfort.

In wet shaving, skin doming is generally controlled by adding a rubbery skin stretcher that increases skin friction. This is located in front of the cutting element, the wet-shaving razor usually having one clear direction of use over the skin. By stretching the skin taut, its ability to dome ahead of the cutting element or blade is reduced. A lubricity strip may also be placed behind the cutting element or blade, which further enhances the stretching effect on the skin. Devices have also been proposed that actively seek to stretch the skin as described in EP1697095.

In dry shaving, the shaver is frequently moved in multiple directions over the skin. This means that in rotary dry shaving or in linear foil electric shaving the guard or skin engaging surface is limited by having to allow for movement over the skin in any direction.

A skin stretching solution of the type used in wet shaving systems is therefore not possible. In certain designs, the guard member (a foil or a shaving cap) or a skin engaging surface of the shaving head may be provided with stretching elements in the form of rings or protrusions which assist in supporting the skin and controlling the pressure and angle at which it comes into contact with the cutting element. A rotary shaver provided with a skin stretching element is disclosed in WO02051598.

It would therefore be desirable to provide a shaver that allowed better control of skin doming irrespective of the direction of movement of the shaver across the skin.

BRIEF SUMMARY OF THE INVENTION

According to the invention there is provided a shaver comprising a skin engaging portion and a cutting element, wherein the skin engaging portion comprises a force-generating member configured and arranged to generate a force of attraction to the skin of a user and the shaver further comprising a control element that can selectively adjust said force of attraction during use. As a result of an increase in the force of attraction, the local frictional force during movement across the skin will also be increased. This increased frictional force can be used to selectively stretch the skin and thus reduce skin doming. It will be understood that the frictional force between the skin-engaging surface and the skin will depend upon the coefficient of friction and upon the force applied by the user. Nevertheless, selectively increasing the frictional force in one region relative to other regions can take place independently of the overall force applied by the user.

Various methods of locally varying the force of attraction may be envisaged, including the use of suction provided by small nozzles or openings in the skin engaging portion and a suitable source of vacuum. Nevertheless, according to a preferred embodiment of the invention, the force-generating member comprises an electro-adhesive element, which is attracted to the skin surface by electrostatic attraction. The principles of electrostatic attraction and electro-adhesion are well known and may be embodied in different forms according to the desired configuration and operation of the shaver. The basic principle of an electrostatic effect on the skin has been discovered and described by Mallinckrodt et al. in 1950 and published in "Perception by the skin of electrically induced vibrations", Science 118 (3062: 277-278, 1953). More recently commercial embodiments have been developed allowing electro-adhesion to be used for various purposes including wall-climbing robots and the like.

The electro-adhesive element may comprise charge-holding conductors or electrodes shielded from the skin by a thin insulator. The electrodes can be moulded into an otherwise non-conductive skin-engaging portion e.g. using a graphite or conducting filler within a composite body. Alternatively, they may be applied onto the skin engaging portion with an insulating lacquer layer (widely known for e.g. wire windings) applied to cover the electrodes. The arrangement can thus be made economically within the shape and constraints of the shaving system In one embodiment of the invention, the electrodes are charged with an alternating voltage, preferably to between 70V and 200V. The switching frequency may be adjusted according to the desired result and may typically be from 50 to 200 Hz. Any leak current to the skin is in the micro Ampere range or below and not noticeable to the user.

In an alternative embodiment of the invention, the electro-adhesive element comprises adjacent first and second electrodes connected to a DC source such that the first and second electrodes may be oppositely charged with respect to each other. This enables a DC voltage, not requiring switching, to induce a change in attraction to the surface by the skin According to a still further aspect of the invention, the control element may comprise a sensor for measuring a parameter associated with the skin and a controller for selectively adapting the force of attraction in response to a measured property of the parameter. In this manner, direct feedback based on real time measurements at the skin surface may allow the force of attraction to be varied in order to improve the shaving effect. It will be understood that in the absence of such feedback, the force of attraction may be adapted on the basis of other parameters or on the basis of a predefined program.

Various parameters may be sensed and used for control of the force of attraction. In one preferred embodiment, the parameter may be indicative of a direction of movement of the skin-engaging portion with respect to the skin. This can allow the controller to adapt the force of attraction to ensure that a high force is present ahead of the cutting element compared to a force of attraction behind the cutting element. Various methods exist for detecting the shaving direction. An electrical switch may be provided, actuated by the friction and motion of the skin-engaging portion across the skin. In a more preferred embodiment, an optical sensor may be provided, arranged in the manner as commonly used in a computer mouse. The sensor takes images at a frequency of around 30 Hz and calculates a motion vector from the deltas between successive images. The net motion vector is evaluated by or provided to the controller.

Another parameter that may preferably be measured is a parameter indicative of a degree of doming of the skin ahead of the cutting element. A robust method of detecting the skin doming is to measure the actual doming or doming pressure directly. This can be achieved by placing a sensing probe in a relevant position between the skin-engaging portion and cutting element.

In a simple form, the measuring device may be capable of distinguishing between two states of skin doming, e.g. high and low. The controller may be arranged to increase the force of attraction on detection of the degree of doming exceeding a predetermined value. This enables the skin stretcher to switch to high-friction or low-friction depending on the detected state. A sufficient steady-zone between the two states, either in time or in measured values, will avoid hysteresis and enable the system to be practical and have an actual benefit in reducing skin doming variations by attenuating extreme cases of doming. A higher resolution sensing arrangement will enable more optimal control systems, as are widely known from the field of feedback control technology.

The actual sensor can be a piezo element that is in contact with the skin during shaving. This enables a force measurement even in a wet environment in a wet shaving system. An alternative, optical system may use a close-range IR proximity sensor. Even in the case of wet shaving using foam, this may provide a usable proxy value of skin doming. In a rotary or reciprocating system, skin doming may be measured in a recess in a face plate or alternatively through the slots formed in a foil or cap. A further alternative is a mechanical element, arranged to touch and trace over the skin just ahead of the blade, between the skin engaging portion (guard) and cutting element. This may be coupled to a potentiometer element to measure a skin doming value. The benefit of electrical measurement methods is that they enable direct feedback to the force-generating member.

In a still further preferred embodiment, the skin-engaging portion comprises a plurality of force-generating members and the force of attraction of each force-generating member or group of force-generating members can be selectively adapted independently of the other force-generating members. Such an arrangement is particularly useful for shavers that can be advanced in different directions during cutting, such as rotary or reciprocating shavers as it specifically allows those portions to be adapted that are ahead of the cutting element. Such shavers may be characterized as those where the cutting element is moveable with respect to the skin-engaging portion to perform cutting of hairs during shaving. A controller and direction sensor as described above may be arranged to selectively adjust the force of attraction of those force-generating members located ahead of the cutting element in a measured direction of movement of the shaver across the skin. Preferably, the shaver comprises a plurality of cutting elements, each comprising a rotary shaving head having a rotating cutter. The heads may be mounted to a face plate and the force-generating members that can be selectively activated are located in regions of the face plate surrounding the rotary shaving heads. It will however also be understood that skin engaging regions of the cap or head of a rotary shaver may also be provided with such force-generating members.

In a particular embodiment of the invention, the skin engaging portion of the shaver comprises a face plate in which a plurality of cutting elements are located, each comprising a rotary shaving head having a rotating cutter, and a plurality of force-generating members are provided, distributed around a periphery of the face plate, wherein the controller is operable in response to a direction of movement measured by the sensor to selectively increase the force of attraction of those force generating members located ahead of the rotary shaving heads with respect to the measured direction of movement.

As mentioned above however, the shaver may also be a wet-shaver having one or more elongate blades mounted in a guard. In this case, the regions that can be selectively activated may be located on the skin-engaging portion of the guard.

The invention also relates to a method of controlling operation of a shaver comprising moving a skin engaging portion of the shaver across the skin of a user in a direction of motion, whereby the skin engaging portion engages the skin and a cutting element engages hairs to be cut, and adjusting a force of attraction between the skin and at least a region of the skin engaging portion during said movement, in order to adjust a degree of stretching of the skin ahead of the cutting element. As described above, by stretching the skin in this manner, doming can be reduced and improved comfort may be achieved.

In one preferred form, the method comprises measuring a parameter indicative of skin doming ahead of the cutting element and selectively adjusting the force of attraction to adjust such skin doming.

The method may also or alternatively comprise measuring a parameter indicative of the direction of motion and selectively increasing the force of attraction ahead of the cutting element, whereby doming may controlled irrespective of a direction of movement of the shaver.

BRIEF DESCRIPTION OF THE DRAWINGS

The features and advantages of the invention will be appreciated upon reference to the following drawings of a number of exemplary embodiments, in which.

DESCRIPTION OF ILLUSTRATIVE EMBODIMENTS

Figure 1:
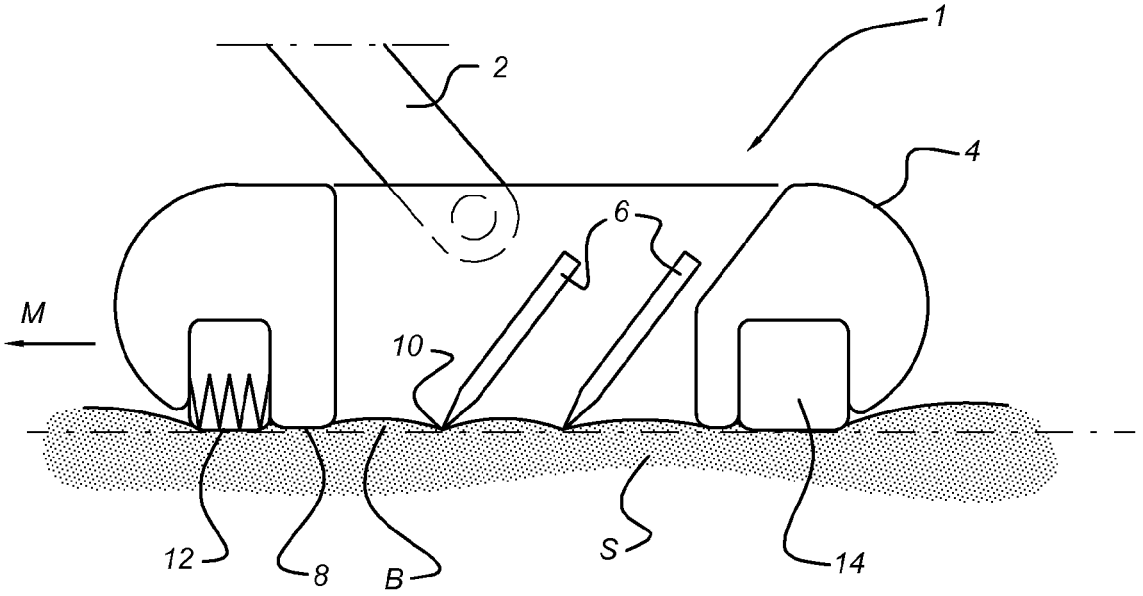
FIG. 1 shows a schematic cross-section of a conventional wet shaver.

FIG. 1 shows a schematic cross-sectional view of a conventional wet shaver 1 comprising a handle 2, a guard 4 and a pair of cutting blades 6 mounted within the guard 4. The guard has a skin-engaging portion 8 and the cutting edges 10 of the blades 6 lie approximately in the plane of the skin-engaging portion 8.

During use, the skin-engaging portion 8 of the shaver 1 is pressed against the user's skin S and moved in a direction M. Due to the pressure exerted by the blades 6 and its inherent elasticity, the skin S is caused to form a bulge B extending towards the guard 4 in those areas where it is unsupported, such as between the blades 6 and between the blades 6 and the guard 4. This effect is known as doming. In order to reduce doming, the guard is provided with a skin-stretcher 12 ahead of the blades 6 and a lubricity strip 14 behind the blades 6. The skin-stretcher 12 is a region of increased friction comprising a ribbed rubber-like portion. The lubricity strip 14 comprises a lubricious water-soluble polymer and provides a region of reduced friction. The net effect of these regions is to cause the skin to be stretched or held taut in the area of the blades, thus reducing the amount of doming.

Figure 2:
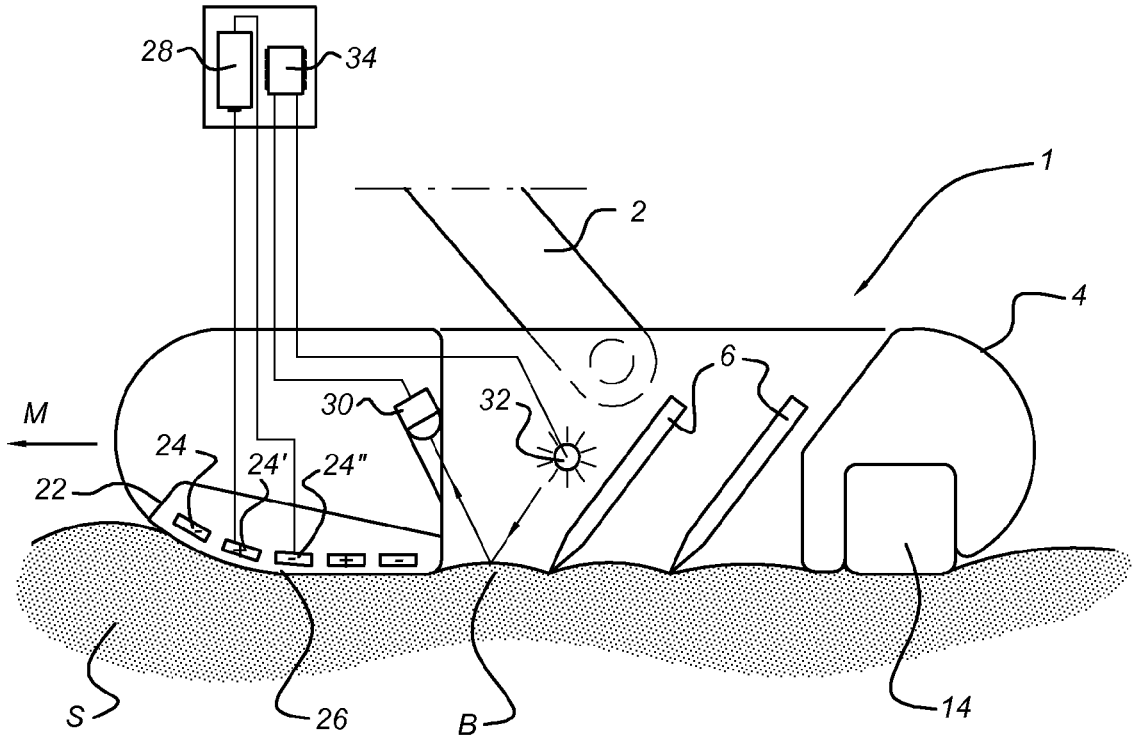
FIG. 2 shows a schematic cross-section of a shaver according to a first embodiment of the present invention

FIG. 2 shows a wet shaver 20A according to a first embodiment of the present invention in a schematic cross-sectional view similar to that of FIG. 1, in which like elements are given similar references. The shaver 20 is generally similar to the conventional shaver 1, with the exception of the skin-stretcher 12, which is replaced by an electro-adhesive element 22. The electro-adhesive element 22 comprises a plurality of electrodes 24 embedded in an insulating layer 26. Alternate electrodes 24', 24" are connected to +ive and −ive terminals of a DC voltage source 28. By connecting the voltage source 28, the electrodes 24 become charged and induce a local charge onto the skin S, which is thus attracted by electrostatic force towards the element 22. FIG. 2 also shows a sensor 30 located on the guard 4 for determining the degree of skin doming ahead of the blades 6. The sensor 30 is an infrared (IR) photodiode capable of detecting IR radiation. An IR light source in the form of an LED 32 is also located within the guard 4 at a slight distance from the sensor 30. The sensor 30 and LED 32 are both connected to a controller 34, which includes appropriate circuitry for processing their signals. In use, the LED 32 emits IR light, which is reflected by the skin S. The controller 34 is set to determine when a bulge B is formed. At this point, a signal is given to the voltage source 28 to increase the applied voltage to the electrodes 24 in order to increase the electro-adhesive force. This results in increased friction ahead of the blades 6 and greater stretching of the skin S, leading to a reduction in the size of the bulge B. Although a simple control principle has been described, the skilled person will be well aware that more complex sensor circuitry may be used to evaluate proximity by modulation and triangulation techniques and that alternative acoustic, piezo-electric and tactile sensors may also be employed.

Figure 3:
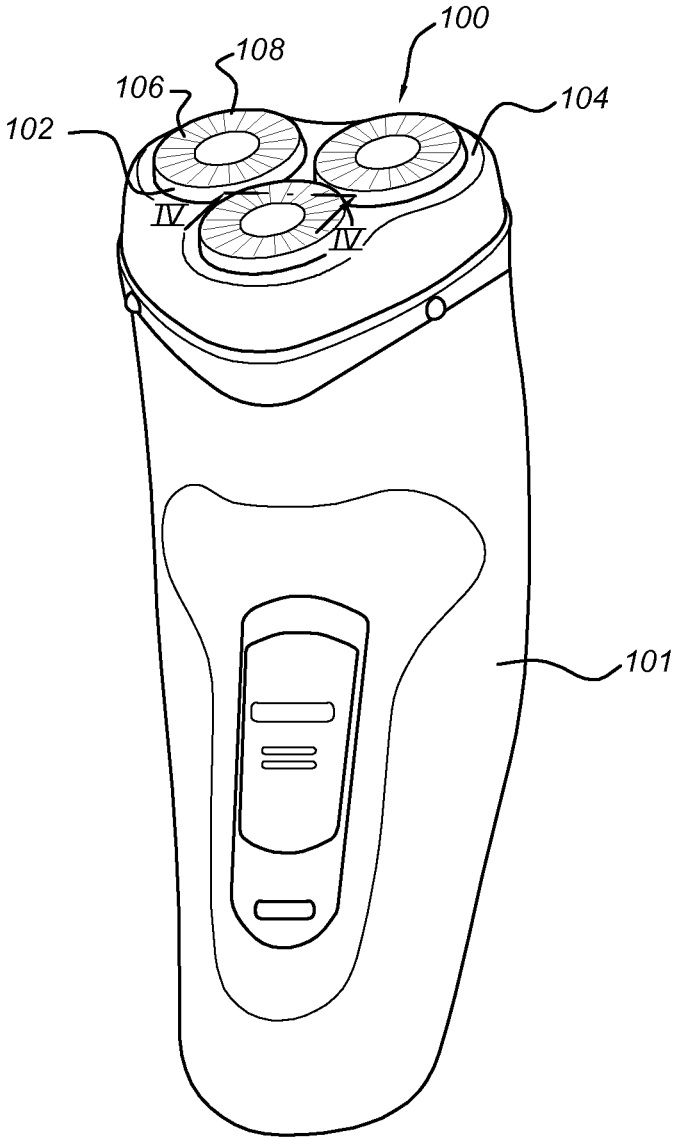
FIG. 3 shows a perspective view of a conventional rotary shaver.

FIG. 3 illustrates a conventional rotary electric shaver 100 used for "dry" shaving. The shaver 100 comprises a body 101 and three heads 102 mounted in a face plate 104. Each of the heads comprises an outer cap 106, having a plurality of hair receiving slots 108 by which hairs may enter into the cap 106 and be cut by a rotating cutter beneath (see below).

Figure 4:
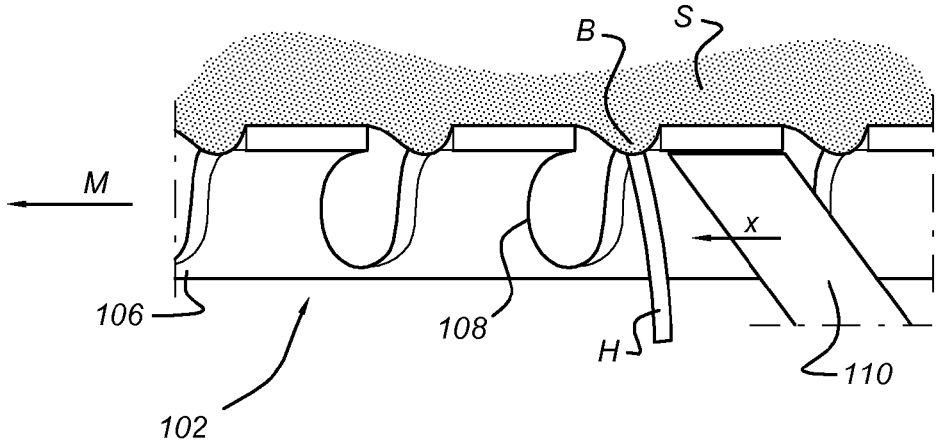
FIG. 4 shows a partial cross-section through the shaver of FIG. 3 along line IV-IV.

FIG. 4 shows a detail through one of the heads 102 taken on line IV-IV in FIG. 3. Showing a hair H protruding through slot 108 of cap 106. Cutter 110 is shown moving in direction X to cut hair H by interaction with the slot 108 as is otherwise conventional. FIG. 4 also shows the manner in which the skin S bulges into the slots 108 at B. In this view, the head 102 is moving in the direction M which corresponds to the direction X. The bulge B is therefore pushed against one side of the slot 108. It will however be understood that the cutter 110 rotates and its local direction of movement X does not therefore always correspond to the direction of movement M of the head 102 across the skin S.

Due to the bulge B of skin into the slots 108, the skin S may become damaged by contact with the cutter 110. This damage may be reduced by various means, including increasing the thickness of the cap 106 and reducing the width of the slots 108. Most of these adaptations have a negative effect on the closeness of the ultimate shave that can be achieved.

Figure 5:
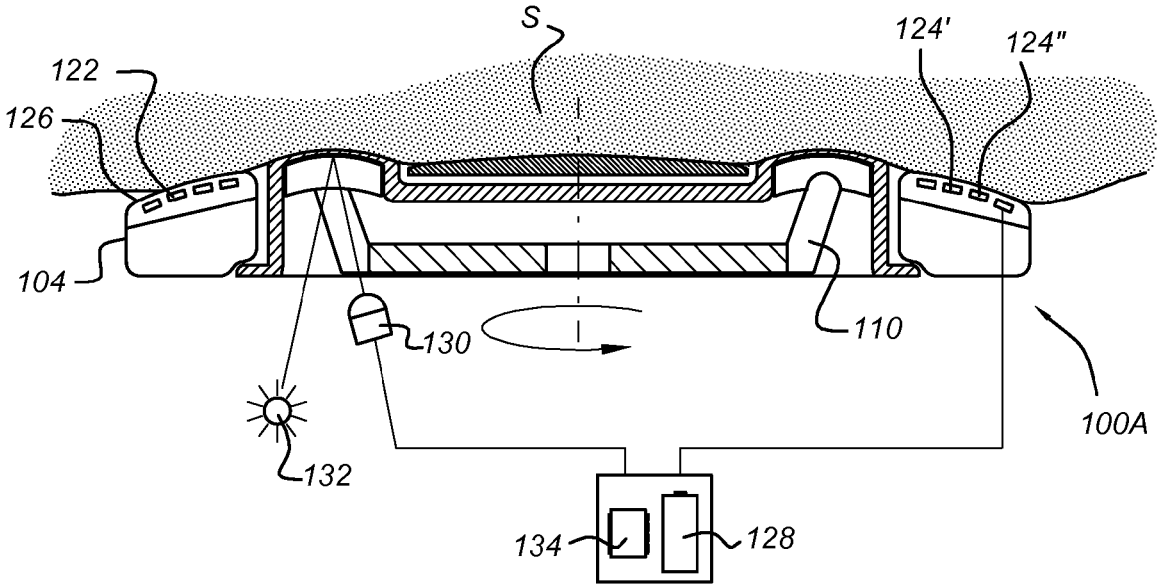
FIG. 5 shows a schematic cross-section through a rotary shaver according to the present invention.

FIG. 5 shows a schematic cross section through part of a rotary shaver 100A according to an embodiment of the present invention. Like elements to those of FIGS. 3 and 4 will be designated with like numerals.

According to FIG. 5, the face plate 104 is provided with electro-adhesive elements 122. The electro-adhesive elements 122 each comprise a plurality of electrodes 124 embedded in an insulating layer 126 in the same manner as those described above in relation to FIG. 2. Alternate electrodes 124', 124" are connected to +ive and −ive terminals of a DC voltage source 128. By connecting the voltage source 128, the electrodes 24 become charged and induce a local charge onto the skin S, which is thus attracted by electrostatic force towards the element 122.

Also similarly to FIG. 2, a sensor 130 is located on the face plate 104 for determining the degree of skin doming. The sensor 130 is an IR photodiode which operates together with an IR LED 132 to determine the bulging of the skin S through the slots 108 in the cap 106. The sensor 130 and LED 132 are both connected to a controller 134, which includes appropriate circuitry for processing their signals. In use, the LED 132 emits IR light, which is reflected by the skin S. The controller 134 is set to determine an amount of bulge B and issue a signal to the voltage source 128 to increase the applied voltage to the electrodes 124 in order to adjust the electro-adhesive force as required. In the present embodiment, bulging is measured through the cap but it is understood that this may be measured at various positions including at a recess formed in the face plate, ahead of the face plate or between the face plate and the cap or foil.

Although a simple control principle has been described, the skilled person will be well aware that more complex sensor circuitry may be used to evaluate proximity by modulation and triangulation techniques and that alternative acoustic, piezo-electric and tactile sensors may also be employed.

Figure 6:
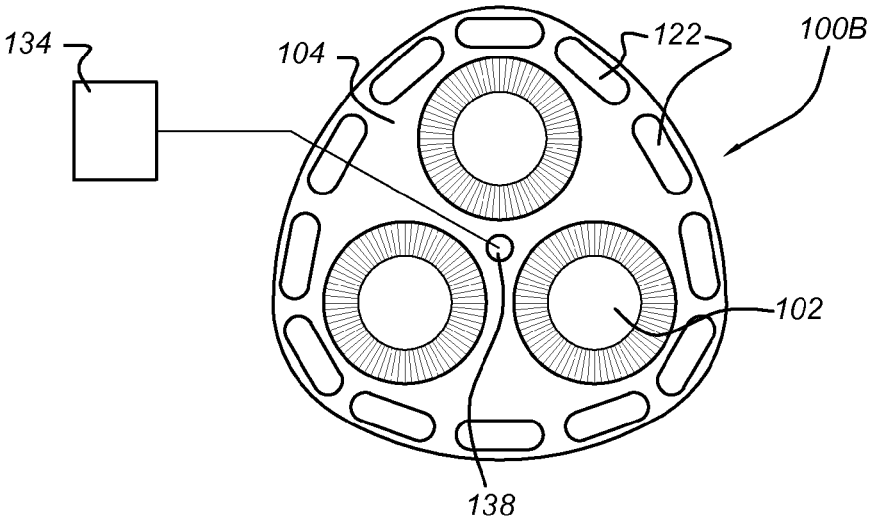
FIG. 6 shows a frontal view of the face plate of a rotary shaver according to a second embodiment of the invention.

FIG. 6 shows a schematic frontal view of the face plate 104 of a rotary shaver 100B according to a further embodiment of the invention. Like elements to those of FIGS. 3 and 5 are given like references.

FIG. 6 differs from the embodiment of FIG. 5 by the presence of a plurality of electro-adhesive elements 122 distributed around the periphery of the face plate 104 and an optical direction sensor 138 which in this embodiment is located at the centre of the face plate. The optical sensor 138 is operatively connected to the controller 134.

Figure 7A:
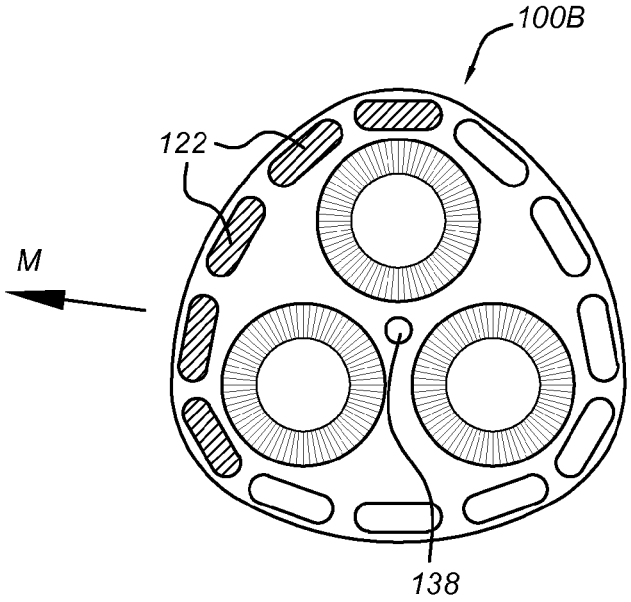
FIGS. 7A and 7B show views of the shaver of FIG. 6 during use.
Figure 7B:
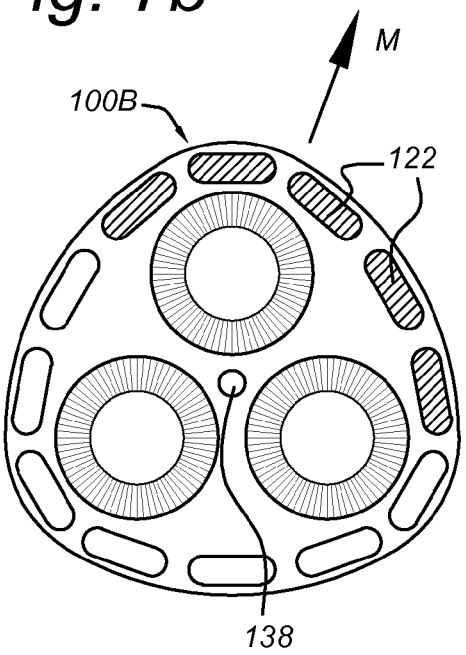

FIGS. 7A and 7B illustrate frontal views of the face plate 104 of FIG. 6 during operation of the shaver 100B. During use, the optical sensor 138 takes images at a frequency of around 30 Hz and the controller 134 calculates a motion vector from the differences between successive images. The controller 134 uses the motion vector to determine the direction and speed of movement M. Based on this measurement, it increases the attractive force of the electro-adhesive elements 122 that are located ahead of the heads 102 and it decreases the attractive force of the elements 122 that are located behind the heads 102, relative to the direction of movement M. The skin is thus held tight and skin doming is reduced.

Thus, the invention has been described by reference to certain embodiments discussed above. It will be recognized that these embodiments are susceptible to various modifications and alternative forms well known to those of skill in the art. In particular, the arrangement of FIGS. 5 to 7 may also be applied to reciprocating shavers using a foil instead of the cap disclosed.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A shaver comprising:

a skin engaging portion and a cutting element, wherein the skin engaging portion comprises a force-generating member, configured and arranged to generate a force of attraction to the skin of a user, wherein the force-generating member comprises an electro-adhesive element comprising at least two charge-holding electrodes connected to a voltage source to output a voltage to induce a local charge onto the skin of the user, the electro-adhesive element covered by an insulating layer to prevent contact between the at least two charge-holding electrodes and the skin, a control element configured to selectively adjust said force of attraction during use, wherein the control element comprises a sensor for measuring a parameter associated with the skin and, a controller configured to control the voltage source to change the voltage to selectively adapt the force of attraction in response to a measured property of the parameter.

2. The shaver according to claim 1, wherein the parameter is indicative of a direction of movement of the skin engaging portion with respect to the skin.

3. The shaver according to claim 2, wherein the controller is arranged to selectively adjust the force of attraction of the force-generating members located ahead of the cutting element in a measured direction of movement of the shaver across the skin.

4. The shaver according to claim 2, wherein the skin engaging portion comprises a face plate in which a plurality of cutting elements are located, each comprising a rotary shaving head having a rotating cutter, and a plurality of force-generating members are provided, distributed around a periphery of the face plate, wherein the controller is operable in response to a direction of movement measured by the sensor to selectively increase the force of attraction of those force generating members located ahead of the rotary shaving heads with respect to the measured direction of movement.

5. The shaver according to claim 1, wherein the parameter is indicative of a degree of doming of the skin ahead of the cutting element.

6. The shaver according to claim 5, wherein the controller is arranged to increase the force of attraction on detection of the degree of doming exceeding a predetermined value.

7. The shaver according to claim 1, wherein the skin engaging portion comprises a plurality of force-generating members and the force of attraction of each force-generating member can be selectively adapted independently of the other force-generating members.

8. The shaver according to claim 1, wherein the cutting element is moveable with respect to the skin engaging portion to perform cutting of hairs during shaving.

9. The shaver according to claim 8, wherein the shaver comprises a plurality of cutting elements each comprising a rotary shaving head having a rotating cutter.

10. The shaver according to claim 1, wherein the shaver is a wet-shaver having one or more elongate blades mounted in a guard.

11. The shaver according to claim 1, wherein the cutting element is moveable with respect to the skin engaging portion to cut hairs during shaving.

12. A method of controlling operation of a shaver comprising:

moving a skin engaging portion of the shaver across a skin of a user in a direction of motion, whereby the skin engaging portion engages the skin and a cutting element of the shaver engages hairs to be cut, wherein the skin engaging portion includes a force-generating member configured to generate a force of attraction;

adjusting the force of attraction between the skin and at least a region of the skin engaging portion during said movement, in order to adjust a degree of stretching of the skin ahead of the cutting element, wherein the force-generating member comprises an electro-adhesive element comprising two charge-holding electrodes connected to a voltage source to output a voltage to induce a local charge onto the skin of the user, the electro-adhesive element being covered by an insulating layer to prevent contact between the at least two charge-holding electrodes and the skin;

measuring a parameter associated with the skin; and selectively adapting the force of attraction in response to a measured property of the parameter by controlling the voltage source to change the voltage.

13. A shaver comprising:

a skin engaging portion: and a cutting element, wherein the skin engaging portion comprises a force-generating member, configured and arranged to generate a force of attraction to the skin of a user, wherein the force-generating member comprises an electro-adhesive element comprising adjacent first and second charge-holding electrodes covered by an insulating layer to prevent contact between the electrodes and the skin and connected to a DC source such that the first and second electrodes may be oppositely charged with respect to each other, a control element configured to selectively adjust said force of attraction during use, wherein the control element comprises a sensor for measuring a parameter associated with the skin and, a controller configured to selectively adapt the force of attraction in response to a measured property of the parameter.

14. The shaver according to claim 13, wherein the parameter is indicative of a direction of movement of the skin engaging portion with respect to the skin.

15. The shaver according to claim 13, wherein the parameter is indicative of a degree of doming of the skin ahead of the cutting element.

16. The shaver according to claim 13, wherein the controller is arranged to increase the force of attraction on detection of the degree of doming exceeding a predetermined value.

17. The shaver according to claim 13, wherein the skin engaging portion comprises a plurality of force-generating members and the force of attraction of each force-generating member can be selectively adapted independently of the other force-generating members.

18. The shaver according to claim 13, wherein the controller is arranged to selectively adjust the force of attraction of the force-generating member located ahead of the cutting element in a measured direction of movement of the shaver across the skin.

* * * * *